US010900245B2

(12) United States Patent
Bunn, Jr. et al.

(10) Patent No.: US 10,900,245 B2
(45) Date of Patent: Jan. 26, 2021

(54) HANDRAIL ASSEMBLY JIG

(71) Applicants: Kenneth Bunn, Jr., Wyoming, MI (US); Kenneth Earl Bunn, Sr., Wyoming, MI (US)

(72) Inventors: Kenneth Bunn, Jr., Wyoming, MI (US); Kenneth Earl Bunn, Sr., Wyoming, MI (US)

( * ) Notice: Subject to any disclaimer, the term of this patent is extended or adjusted under 35 U.S.C. 154(b) by 0 days.

(21) Appl. No.: 16/931,925

(22) Filed: Jul. 17, 2020

(65) Prior Publication Data

US 2020/0347623 A1 Nov. 5, 2020

Related U.S. Application Data

(60) Provisional application No. 62/931,424, filed on Nov. 6, 2019.

(51) Int. Cl.
*E04G 21/18* (2006.01)
*E04F 11/18* (2006.01)

(52) U.S. Cl.
CPC ..... *E04G 21/1841* (2013.01); *E04F 11/1802* (2013.01)

(58) Field of Classification Search
CPC ..... E04G 21/1841; E04F 11/1802; B43L 13/002; B43L 7/007; B43L 7/02; B43L 7/12; B43L 7/125; B43L 7/14; G01B 3/566; G01C 9/28
USPC ..... 33/645
See application file for complete search history.

(56) References Cited

U.S. PATENT DOCUMENTS 2,883,759 A * 4/1959 Einbinder ..... E04G 13/062 33/645
3,478,434 A * 11/1969 Catalano ..... E04F 21/26 33/418
5,018,912 A 5/1991 Reitz
5,461,798 A * 10/1995 Ribeiro ..... E04F 21/26 33/415
5,527,016 A 6/1996 Wilkerson, Jr.
5,628,119 A 5/1997 Bingham et al.
5,692,357 A * 12/1997 McCain ..... B25B 11/02 33/194
6,082,019 A * 7/2000 Lapp, Jr. ..... G01B 3/1084 33/760
6,119,356 A 9/2000 Frankland
7,254,920 B2 * 8/2007 Steele ..... E04F 21/185 33/371
8,807,537 B1 8/2014 Vorrath
(Continued)

FOREIGN PATENT DOCUMENTS

JP 2017-359278 * 6/2017 ..... E04F 21/00

*Primary Examiner* — Yaritza Guadalupe-McCall
(74) *Attorney, Agent, or Firm* — Boudwin Intellectual Property; Daniel Boudwin

(57) ABSTRACT

A handrail assembly jig is provided. The handrail assembly jig includes a vertical support having a first end and a second end. A planar base is affixed to the second end of the vertical support. A foot member is removably secured to the second end, wherein the foot member includes a planar foot base. A head member is slidably affixed to the vertical support at the first end. A clamp is removably secured to a lower side of the head member. An arm is pivotally secured to the second end, wherein the arm includes a slot therethrough. A securement device can be inserted through the slot to selectively raise and lower the arm relative to the vertical support.

20 Claims, 5 Drawing Sheets

(56) References Cited

U.S. PATENT DOCUMENTS

| | | | | |
|---|---|---|---|---|
| 8,826,555 | B2 * | 9/2014 | Ruonavaara | E04G 21/1816 33/406 |
| 2004/0181955 | A1 * | 9/2004 | Sargent | B43L 7/10 33/473 |
| 2006/0010672 | A1 | 1/2006 | Kuenzel | |
| 2007/0113416 | A1 * | 5/2007 | Reed | B43L 7/02 33/474 |
| 2009/0025238 | A1 * | 1/2009 | Bowman | E04F 21/26 33/472 |
| 2014/0008596 | A1 * | 1/2014 | Herman | B23B 49/02 256/46 |
| 2015/0233131 | A1 * | 8/2015 | Hofstetter | E04F 21/26 33/427 |

* cited by examiner

HANDRAIL ASSEMBLY JIG

CROSS REFERENCE TO RELATED APPLICATIONS

This application claims the benefit of U.S. Provisional Application No. 62/931,424 filed on Nov. 6, 2019. The above identified patent application is herein incorporated by reference in its entirety to provide continuity of disclosure.

BACKGROUND OF THE INVENTION

The present invention relates to handrail installation devices. More particularly, the present invention pertains to a handrail assembly jig configured to align and hold a handrail in position while the user installs the handrail to a wall surface.

Many individuals, whether professional or consumer, renovate living spaces or build additions onto homes. Many such renovations include adding or modifying a staircase, including installing a handrail. However, installing a handrail assembly can be a frustrating experience, requiring a large time investment and possibly including several mistakes that must be corrected. Handrails must be installed at a proper height relative to the staircase to ensure that the renovation meets building codes. Failing to properly install a handrail at a consistent height along the length of the staircase requires additional time to correct such mistakes. Additionally, the process often requires more than one person, as both ends of the handrail must be supported simultaneously to ensure that the handrail is properly aligned. Therefore, a device that allows a user to install a staircase handrail easily and efficiently by properly aligning and holding the handrail in position is desired.

In light of the devices disclosed in the known art, it is submitted that the present invention substantially diverges in design elements from the known art and consequently it is clear that there is a need in the art for an improvement to existing handrail installation devices. In this regard, the instant invention substantially fulfills these needs.

SUMMARY OF THE INVENTION

In view of the foregoing disadvantages inherent in the known types of handrail installation devices now present in the known art, the present invention provides a handrail assembly jig wherein the same can be utilized for providing convenience for the user when holding and aligning a handrail along a wall surface during the installation thereof.

The present system comprises a vertical support having a first end opposite a second end, wherein a planar base is affixed to the second end. A foot member is removably secured to the second end, wherein the foot member comprises a planar foot base. A head member is slidably affixed to the vertical support at the first end. A clamp is removably secured to a lower side of the head member. An arm is pivotally secured to the second end of the vertical support, wherein the arm comprises a slot therethrough. The slot is configured to receive a securement device therethrough to selectively raise and lower the arm relative to the vertical support. In some embodiments, a ruler extends along a length of the arm indicating a linear distance between a lower end of the arm and an upper end of the arm. In other embodiments, a clamp jaw plate is removably securable to opposing sides of the lower side of the head member, wherein the clamp jaw plate is configured to engage an opposing jaw of the clamp. In some such embodiments, the clamp jaw plate is pivotally affixed to the head member. In another embodiment, a lower alignment plate is disposed on the lower end of the arm, wherein a lower edge of the lower alignment plate is linear. In yet another embodiment, an upper alignment plate is disposed on the upper end of the arm, wherein an upper edge of the upper alignment plate is linear. In some embodiments, the upper alignment plate is slidably disposed on the arm via the slot and is configured to be locked in place along the arm via a second securement device. In another embodiment, the planar foot base and the planar base are coplanar when the foot member is removably secured to the vertical support. In other embodiments, the securement device comprises a wingnut knob.

A method for using the handrail assembly jig comprises providing a pair of vertical supports, each having a first end opposite a second end, placing a front end of each vertical support flush against a central step and an upper step, respectively, raising an arm pivotally secured to the second end of each vertical support such that a lower alignment plate affixed to a lower end of the arm rests against an upper surface of each step, sliding an upper alignment plate disposed on an upper end of the arm to a desired height, lowering a head member slidably disposed on the first end of each vertical support such that a lower projection extending from the head member rests flush against an upper edge of the upper alignment plate, securing a handrail within a clamp disposed on the head member of each of the pair of vertical supports, and affixing the handrail to a wall via mounting brackets. In some embodiments, the method further comprises removing a foot member secured to the second end of the vertical support and placing a forward surface of the foot member against a lower step. In a further embodiment, the method further comprises detaching the upper end of the arm from the vertical support and securing the upper end to the foot member. In another embodiment, the method further comprises aligning the handrail to be parallel to the arm extending between the vertical support and the foot member.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
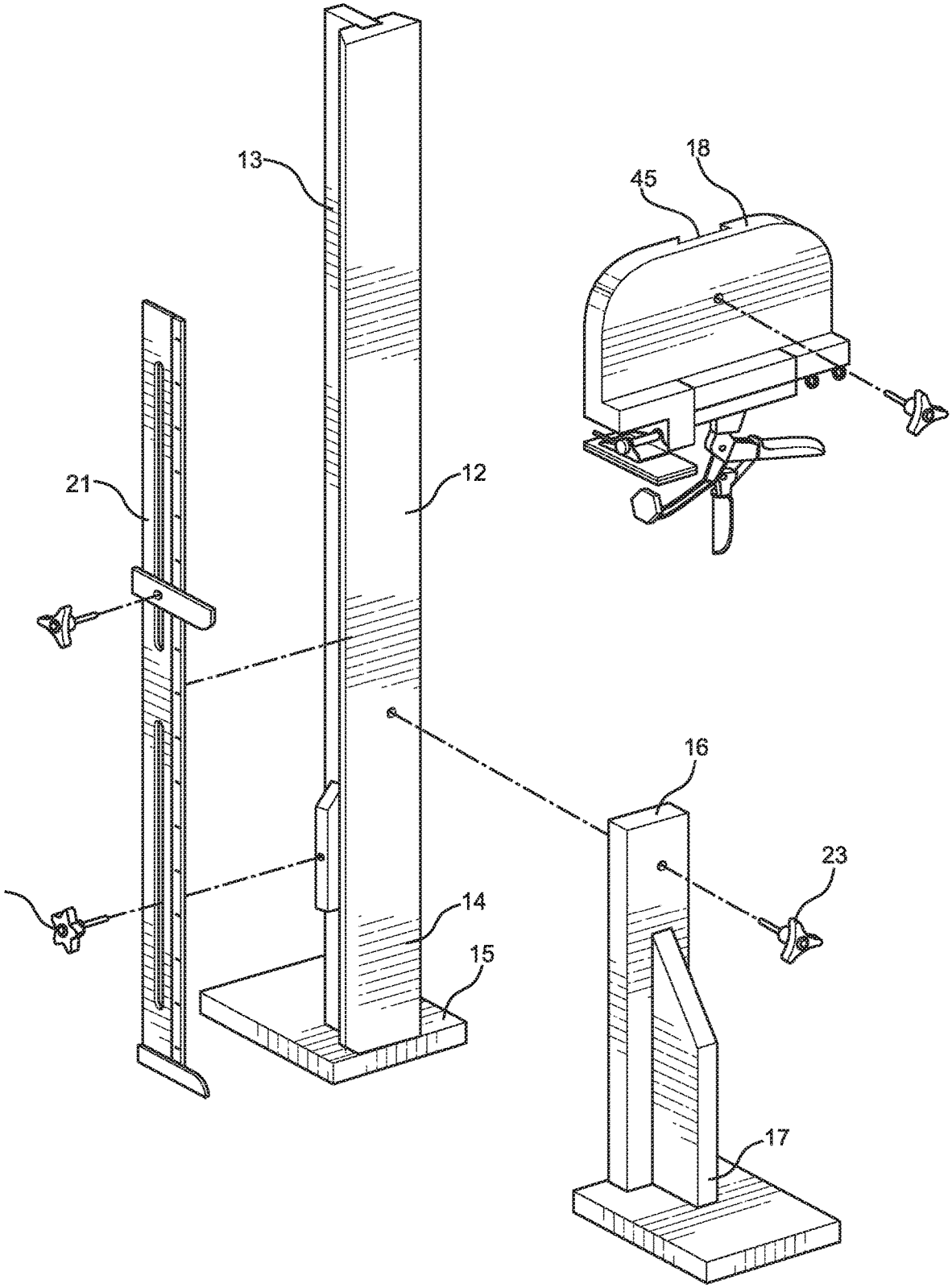
FIG. 1 shows an exploded view of an embodiment of the handrail assembly jig.

Reference is made herein to the attached drawings. Like reference numerals are used throughout the drawings to depict like or similar elements of the handrail assembly jig. The figures are intended for representative purposes only and should not be considered to be limiting in any respect.

Referring now to FIG. 1, there is shown an exploded view of an embodiment of the handrail assembly jig. The handrail assembly jig 11 comprises a vertical support 12 having a first end 13 opposite a second end 14, wherein a planar base 15 is disposed on the second end 14. The planar base 15 provides support to the vertical support 12 to maintain the vertical support 12 in an upright position. In the shown embodiment, the vertical support 12 is positioned along the planar base 15 such that a front side of the vertical support 12 rests flush with an outer edge of the planar base 15. In this manner, the vertical support 12 can be placed such that the vertical support 12 abuts a step of a stairway as further described elsewhere herein. In the illustrated embodiment, the vertical support 12 further comprises a handle 44 therethrough, wherein the handle 44 comprises an opening through a support member disposed perpendicularly to a rear surface of the vertical support 12. The handle 44 provides the user with a gripping surface to allow the handrail assembly jig 11 to be easily transported.

A foot member 16 is removably secured to the second end 14 of the vertical support 12. The foot member 16 further comprises a planar foot base 17, wherein the planar foot base 17 is configured to provide stability to the foot member 16. In the shown embodiment, the foot member 16 is disposed along an edge of the planar foot base 17, similar to the alignment of the vertical support 12 with the planar base 15. In this manner, a forward side of the foot member 16 can be placed flush against a step of a stairway during use as further described elsewhere herein. In the shown embodiment, the foot member 16 is removably secured to the vertical support 12 via a securement device 23, such that the foot member 16 rests flush against the vertical support 12. In this way, the form factor of the foot member 16 and the vertical support 12 combination is reduced to ease transport and storage thereof. In the illustrated embodiment, the securement device 23 comprises a wingnut knob to provide an improved grip, however, in alternate embodiments, other securement mechanisms are contemplated.

A head member 18 is slidably affixed to the vertical support 12 at the first end 13 thereof. In the illustrated embodiment, the head member 18 comprises a channel 45 extending along a rear side thereof, wherein the channel 45 is dimensioned to receive the vertical support 12 therein. In the shown embodiment, the vertical support 12 comprises beveled edges along an upper portion thereof, thereby forming a dove tail sliding groove system in combination with the channel 45 on the rear of the head member 18. The head member 18 can be positioned along the vertical support 12 at a desired height, such that a clamp (as shown in FIG. 3, 19) secures a handrail (as shown in FIG. 4, 40) to the head member 18. In this manner, the handrail can be stabilized at a desired height while the user secures the handrail to a desired wall surface. In the illustrated embodiment, the head member 18 is secured at a desired position via the securement device 23 similarly to the foot member 16. Once the head member 18 has been properly positioned, the securement device 23 can be tightened to frictionally engage the head member 18 to the vertical support 12.

In the illustrated embodiment, an arm 21 is pivotally secured to the vertical support 12 along a longitudinal axis thereof. The arm 21 is pivotally secured to the second end 14 of the vertical support 12 via the securement device 23. The arm 21 can be used to measure a desired height to place the head member 18, and can be further pivoted away from the longitudinal axis of the vertical support 12 and secured to the foot member 16 to provide stability to the handrail assembly jig 11 during use. Further features and functions of the arm 21 are described elsewhere herein.

Figure 2:
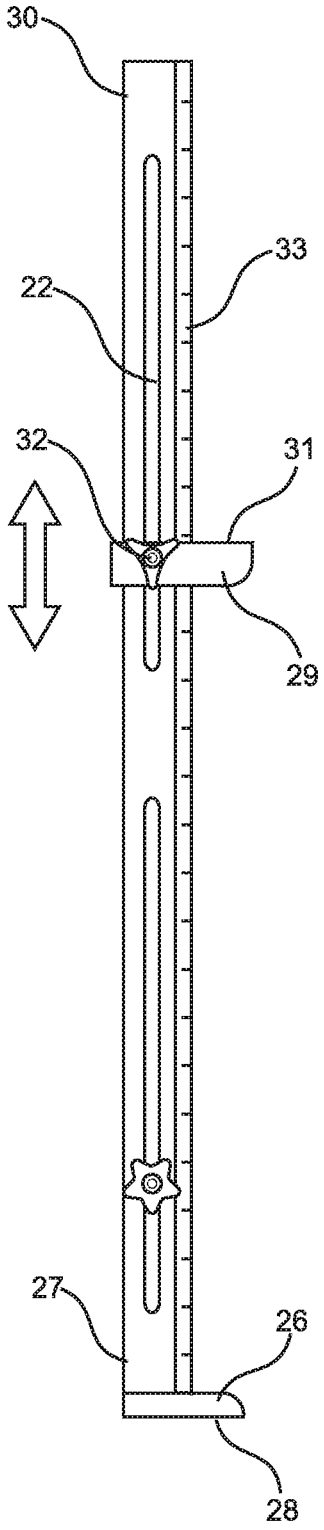
FIG. 2 shows a perspective view of the arm of an embodiment of the handrail assembly jig.

Referring now to FIG. 2, there is shown a perspective view of the arm of an embodiment of the handrail assembly jig. The arm 21 comprises an upper end 30 opposite a lower end 27, wherein the lower end 27 is pivotally secured to the vertical support via the securement device as previously described. The arm 21 further comprises a slot 22 therethrough, wherein the slot 22 extends along a longitudinal axis of the arm 21. In the illustrated embodiment, the slot 22 comprises a pair of distinct slots, however a singular slot 22 is contemplated. The pair of distinct slots provide additional structural stability to the arm 21, as further material separates the pair of slots. The arm 21 can be raised and lowered relative to the vertical support by loosening the securement device from the vertical support and sliding the arm 21 along the slot 22. In this manner, the user can position the arm 21 at a desired height relative to the vertical support. In the shown embodiment, the arm 21 further comprises a ruler 33 thereon, wherein the ruler 33 extends along an edge of the arm 21. The ruler 33 includes indicia thereon to indicate the linear distance between the upper and lower ends 30, 27 of the arm 21, respectively. In this way, the user can align a handrail supported by the handrail assembly jig at a desired height relative to a step in the staircase.

In the illustrated embodiment, a lower alignment plate 26 is affixed to the arm 21 at the lower end 27 thereof. The lower alignment plate 26 further comprises a linear lower edge 28 configured to rest flush against an upper surface (as shown in FIG. 4, 38) of a step adjacent to the step the vertical support is resting on. In this way, the arm 21 can be raised to a height of the adjacent step and maintained at that height by the lower alignment plate 26. This ensures that the head member can be positioned at a desired height as indicated by the ruler 33. In such an embodiment, the lower alignment plate 26 extends beyond the planar base of the vertical support, thereby allowing the lower alignment plate 26 to rest on the adjacent step while the vertical support is resting on a lower step.

In the illustrated embodiment, an upper alignment plate 29 is slidably affixed to the upper end 30 of the arm 21 within the slot 22 via a second securement device 32. The user can loosen the second securement device 32 to allow the upper alignment plate 29 to slide along the arm 21 within the slot 22 and secure the upper alignment plate 29 at a desired height via tightening the second securement device 32. In this way, the position of the upper alignment plate 29 is adjustable in height along the length of the arm 21. The user can align the upper alignment plate 29 along the ruler 33 to ensure that the distance between the lower end 27 of the arm 21 and the upper alignment plate 29 represents the desired height of the handrail to be installed on the wall surface. The second securement device 32 can comprise a wingnut knob similar to the existing securement devices. The upper alignment plate 29 further comprises a linear upper edge 31. The linear upper edge 31 allows the user to place the head member against the upper edge 31 to ensure that a handrail secured by the clamp is maintained at the desired height.

Figure 3A:
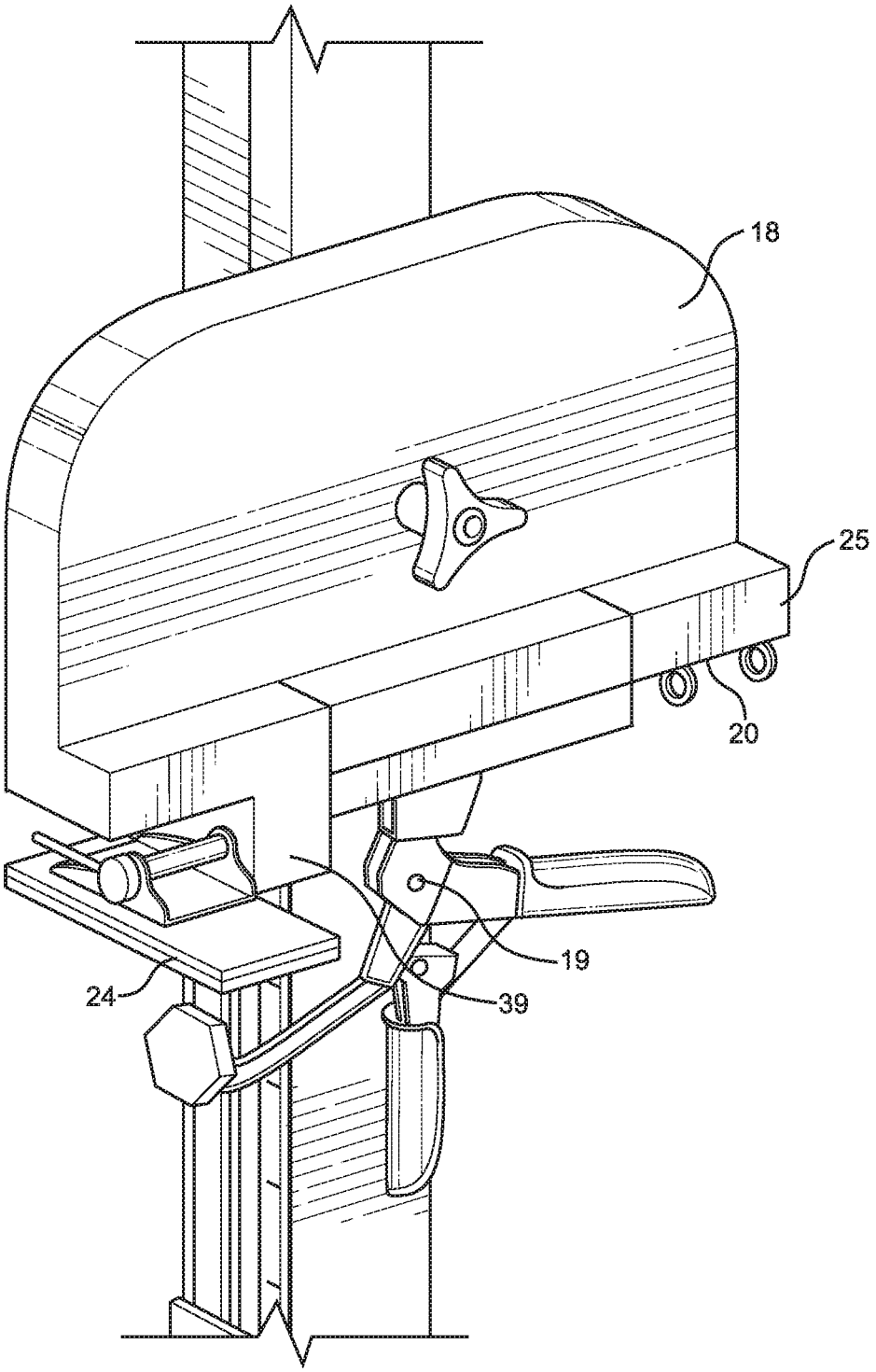
FIG. 3A shows a close-up view of the head member of an embodiment of the handrail assembly jig.
Figure 3B:
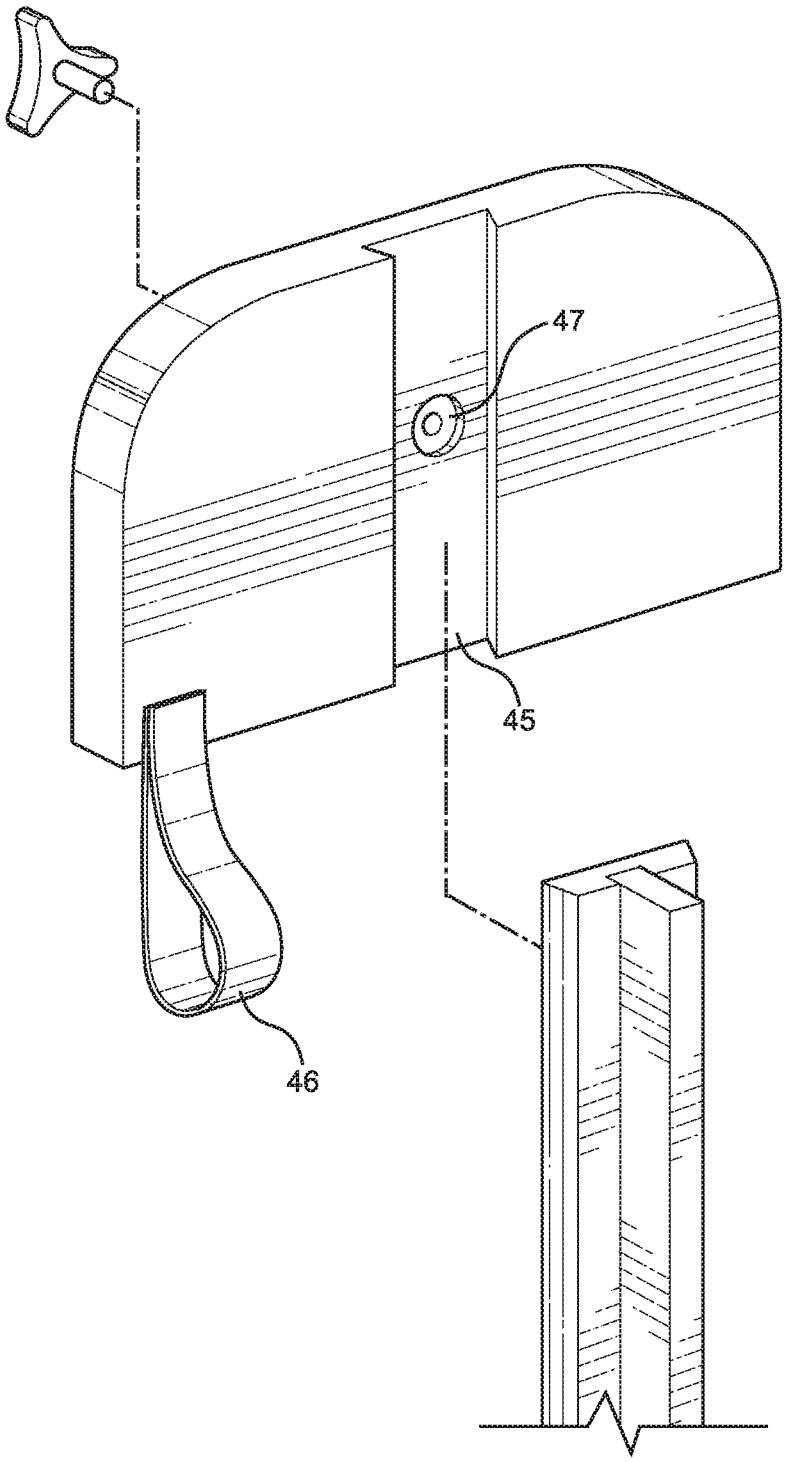
FIG. 3B shows a rear perspective view of the head member of an embodiment of the handrail assembly jig.
Figure 4:
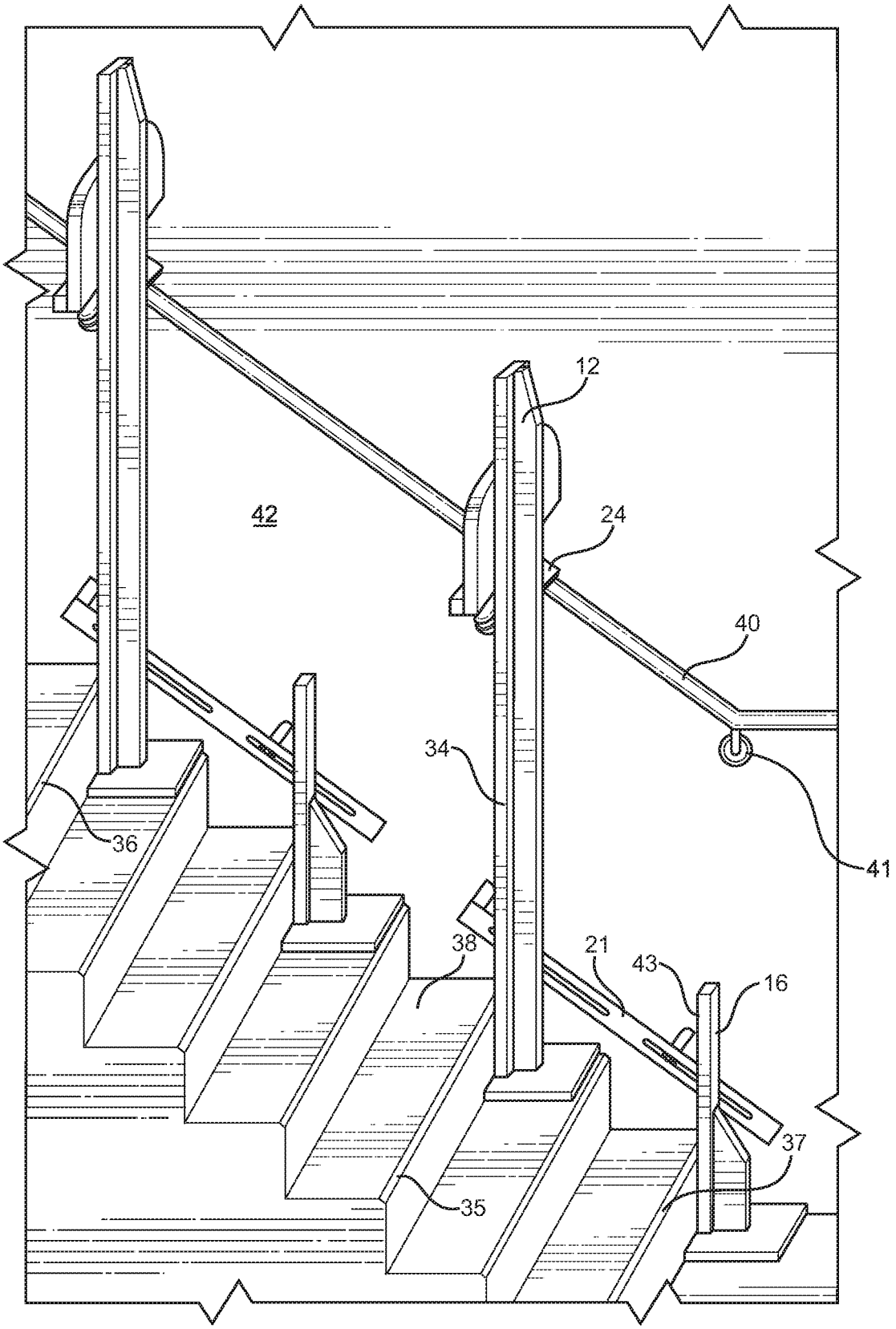
FIG. 4 shows a perspective view of an embodiment of multiple handrail assembly jigs in use.

Referring now to FIGS. 3A and 3B, there are shown a close-up view of the head member of an embodiment of the handrail assembly jig and a rear perspective view of the head member of an embodiment of the handrail assembly jig, respectively. The head member 18 is slidably disposed on the first end 13 of the vertical support, wherein the head member 18 can be selectively moved to a desired height along the vertical support via loosening and retightening the securement device as previously described. In the shown embodiment, the head member 18 further comprises a channel 45 extending between an upper side and a lower side of the head member 18 along a rear surface thereof. The channel 45 is dimensioned to slidably receive the first end 13 of the vertical support therein. In the shown embodiment, opposing lateral sides of the channel 45 are angled to form a dove tail groove system in order to ensure greater surface area in contact with the vertical support, thereby increasing frictional engagement therewith. An aperture 47 extends through the head member 18, wherein the aperture 47 is configured to receive the securement device therethrough. In this manner, the securement device can be tightened to press against the vertical support at a desired height to secure the head member 18 in place.

In the illustrated embodiment, a projection 39 extends from a lower side 20 of the head member 18. The projection 39 is configured to rest flush against the upper edge of the upper alignment plate, such that the head member 18 can be positioned at the height measured by the upper alignment plate. In this manner, the handrail secured by the clamp 19 can be held at the desired height. In the shown embodiment, the projection 39 extends perpendicularly from the lower side 20, such that the projection 39 abuts the upper edge when the head member 18 is lowered. In some embodiments, a projection 39 is disposed on each opposing lateral side 25 of the head member 18, however, in the shown embodiment, the projection is disposed on the side adjacent to the arm, such that the projection abuts the upper edge to ensure the handrail is secured at the appropriate height relative to the staircase.

The clamp 19 is secured to the lower side 20 of the head member 18. In some embodiments, the clamp 19 is pivotally affixed thereto, such that the orientation of the clamp 19 can be adjusted to secure a handrail against either side of the handrail assembly jig. In the shown embodiment, the clamp 19 comprises a singular jaw on a distal end of an arm of the clamp 19 selectively movable between a clamped position and an unclamped position via actuation of the grip of the clamp 19. In some embodiments, the jaw of the clamp 19 is pivotally secured to the distal end to allow the jaw to contour to the shape of various handrail designs. In alternate embodiments, the clamp 19 can comprise a pair of arms, such that the clamp 19 is capable to securing the handrail between the pair of arms without additional support. In the illustrated embodiment, a strap 46 is affixed to a rear surface of the head member 18, wherein the strap 46 comprises a linear segment having a band on a distal end thereof. The band is configured to removably secure a handrail therein, such that the handrail can be supported at a desired height relative to the head member 18 while the handrail assembly jig is being aligned. The strap 46 can comprise fasteners, such as hook and loop fasteners, to open the band to secure about the handrail. In some embodiments, the strap 46 is removably secured to the rear surface of the head member 18, such that the user can alternately utilize the strap on an opposite side of the head member 18 for installing handrails along opposing wall surfaces. In this manner, a single user can utilize the handrail assembly jig as a second person is not necessary to retain an end of the handrail at a desired height while the opposite end of the handrail is being aligned.

In the illustrated embodiment, a clamp jaw plate 24 is affixed to the lower side 20 of a lateral side 25 of the head member 18. The clamp jaw plate 24 is configured to operate as the opposing jaw of the clamp 19, such that the handrail can be grasped between the jaw of the clamp 19 and the clamp jaw plate 24. In some embodiments, the clamp jaw plate 24 is removably securable to opposing lateral sides 25 of the head member 18, such that the user can affix the clamp jaw plate 24 to either side of the handrail assembly jig based on which wall of a staircase the handrail is being secured to. In some such embodiments, a pair of eyelets are affixed to the lower side 20, wherein the pair of eyelets are configured to receive a bolt therethrough, wherein the bolt also extends through a bracket on a rear side of the clamp jaw plate 24. In this manner, the clamp jaw plate 24 is pivotally affixed to the lower side 20, such that the clamp jaw plate 24 can be angled to match the desired installation angle of the handrail when the handrail is secured therebetween. In some embodiments, a lower surface of the clamp jaw plate 24 comprises a high friction material thereon, such that the handrail is frictionally engaged with the clamp jaw plate 24. In other embodiments, the lower surface of the clamp jaw plate 24 can comprise a padded material thereon to prevent damage to the handrail when secured between the clamp 19 and the clamp jaw plate 24.

Referring now to FIG. 4, there is shown a perspective view of an embodiment of multiple handrail assembly jigs in use. In one use, the user places a pair of vertical supports 12 on a staircase, such that a handrail 40 can be secured therebetween at a desired angle and height to allow a user to easily secure the handrail 40 to a wall surface 42. The following disclosure discusses utilizing a singular handrail assembly jig to align and orient a handrail 40 at a desired height and angle, however one having skill in the art will appreciate that the same process can be used with a second handrail assembly jig to allow the handrail 40 to extend therebetween as shown in the associated figure. The user first places a front side 34 of the vertical support 12 flush against a nose of a central step 35 in a staircase. In some embodiments, the foot member 16 is removed from the vertical support 12, such that a forward side 43 of the foot member 16 is placed flush against a nose of a lower step 37. The user can then raise the arm 21 such that the lower edge of the lower alignment plate rests flush against an upper surface 38 of the central step 35. Once the arm 21 is aligned with the upper surface 38 of the central step 35, the user can then adjust the position of the upper alignment plate to a desired height. The user can select the desired height by aligning the upper edge of the upper alignment plate with a desired height indicium shown on the ruler disposed on the arm 21. After the upper alignment plate is secured at the desired height via the second securement device, the user can lower the head member such that the projection rests flush against the upper edge. In this manner, the user can secure the handrail 40 at the desired height between the clamp and the clamp jaw plate 24. In some embodiments, the upper end of the arm 21 can be detached from the vertical support 12, such that the arm 21 can pivot about the lower end thereof. Once detached, the user can re-secure the upper end of the arm 21 to the foot member 16, such that the arm 21 indicates the angle of the staircase. In this manner, the user can compare the angle of the handrail 40 to be installed to the angle of the arm 21 and ensure that the handrail 40 is parallel to the arm 21 to properly align with the slope of the staircase. The user can then repeat the process for the subsequent vertical support 12, placing the front side 34 thereof flush against a nose of an upper step 36. After the handrail 40 is properly positioned and secured between the vertical supports 12, the user can affix the handrail 40 to the wall surface 42 via mounting brackets 41. In this manner, the user can easily and efficiently install a handrail within a staircase.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A handrail assembly jig, comprising:

a vertical support having a first end opposite a second end;

a planar base affixed to the second end of the vertical support;

a foot member removably secured to the second end, wherein the foot member comprises a planar foot base;

a head member slidably affixed to the vertical support at the first end;

a clamp removably secured to a lower side of the head member;

an arm pivotally secured to the second end of the vertical support;

wherein the arm comprises a slot therethrough, the slot configured to receive a securement device therethrough to selectively raise and lower the arm relative to the vertical support.

2. The handrail assembly jig of claim 1, further comprising a clamp jaw plate removably securable to opposing sides of the lower side of the head member, the clamp jaw plate configured to engage an opposing jaw of the clamp.

3. The handrail assembly jig of claim 2, wherein the clamp jaw plate is pivotally affixed to the head member.

4. The handrail assembly jig of claim 1, further comprising a lower alignment plate disposed on a lower end of the arm, wherein a lower edge of the lower alignment plate is linear.

5. The handrail assembly jig of claim 1, further comprising an upper alignment plate disposed on an upper end of the arm, wherein an upper edge of the upper alignment plate is linear.

6. The handrail assembly jig of claim 5, wherein the upper alignment plate is slidably disposed on the arm via the slot and is configured to be locked in place along the arm via a second securement device.

7. The handrail assembly jig of claim 1, wherein the planar foot base and the planar base are coplanar when the foot is secured to the vertical support.

8. The handrail assembly jig of claim 1, wherein the securement device comprises a wingnut knob.

9. A handrail assembly jig, comprising:

a vertical support having a first end opposite a second end;

a planar base affixed to the second end of the vertical support;

a foot member removably secured to the second end, wherein the foot member comprises a planar foot base;

a head member slidably affixed to the vertical support at the first end;

a clamp removably secured to a lower side of the head member;

an arm pivotally secured to the second end of the vertical support;

wherein the arm comprises a slot therethrough, the slot configured to receive a securement device therethrough to selectively raise and lower the arm relative to the vertical support;

a ruler extending along a length of the arm indicating a linear distance between a lower end of the arm and an upper end of the arm.

10. The handrail assembly jig of claim 9, further comprising a clamp jaw plate removably securable to opposing sides of the lower side of the head member, the clamp jaw plate configured to engage an opposing jaw of the clamp.

11. The handrail assembly jig of claim 10, wherein the clamp jaw plate is pivotally affixed to the head member.

12. The handrail assembly jig of claim 9, further comprising a lower alignment plate disposed on a lower end of the arm, wherein a lower edge of the lower alignment plate is linear.

13. The handrail assembly jig of claim 9, further comprising an upper alignment plate disposed on an upper end of the arm, wherein an upper edge of the upper alignment plate is linear.

14. The handrail assembly jig of claim 13, wherein the upper alignment plate is slidably disposed on the arm via the slot and is configured to be locked in place along the arm via a second securement device.

15. The handrail assembly jig of claim 9, wherein the planar foot base and the planar base are coplanar when the foot is secured to the vertical support.

16. The handrail assembly jig of claim 9, wherein the securement device comprises a wingnut knob.

17. A method of using a handrail assembly jig, comprising:

providing a pair of vertical supports, each having a first end opposite a second end;

placing a front side of each vertical support flush against a nose of each of a central step and an upper step, respectively;

raising an arm pivotally secured to the second end of each vertical support such that a lower alignment plate affixed to a lower end of the arm rests against an upper surface of each step;

sliding an upper alignment plate disposed on an upper end of the arm to a desired height;

lowering a head member slidably disposed on the first end of each vertical support such that a lower projection extending from the head member rests flush against an upper edge of the upper alignment plate;

securing a handrail within a clamp disposed on the head member of each of the pair of vertical supports;

affixing the handrail to a wall surface via mounting brackets.

18. The method of claim 17, further comprising removing a foot member secured to the second end of the vertical support and placing a forward side of the foot member against a lower step.

19. The method of claim 18, further comprising detaching the upper end of the arm from the vertical support and securing the upper end to the foot member.

20. The method of claim 19, further comprising aligning the handrail to be parallel to the arm extending between the vertical support and the foot member.

* * * * *